US006802116B2

(12) United States Patent
Österlund et al.

(10) Patent No.: US 6,802,116 B2
(45) Date of Patent: Oct. 12, 2004

(54) METHOD OF MANUFACTURING A METAL-OXIDE VARISTOR WITH IMPROVED ENERGY ABSORPTION CAPABILITY

(75) Inventors: Ragnar Österlund, Ludvika (SE); Teddy Boije, Ludvika (SE)

(73) Assignee: ABB AB, Västeras (SE)

( * ) Notice: Subject to any disclaimer, the term of this patent is extended or adjusted under 35 U.S.C. 154(b) by 0 days.

(21) Appl. No.: 09/811,828

(22) Filed: Mar. 20, 2001

(65) Prior Publication Data

US 2002/0133936 A1 Sep. 26, 2002

(51) Int. Cl.[7] ..... H01C 7/02; H01C 7/04
(52) U.S. Cl. ..... 29/612; 29/613; 338/21
(58) Field of Search ..... 338/13–47; 29/612, 29/613, 614, 610.1

(56) References Cited

U.S. PATENT DOCUMENTS

| | | | | |
|---|---|---|---|---|
| 3,872,582 A | | 3/1975 | Matsuoka et al. | |
| 3,905,006 A | | 9/1975 | Matsuoka et al. | |
| 4,031,498 A | * | 6/1977 | Hayashi et al. | 338/21 |
| 4,069,465 A | * | 1/1978 | Kouchich et al. | 29/610.1 |
| 4,540,971 A | * | 9/1985 | Kanai et al. | 252/519.5 |
| 4,559,167 A | * | 12/1985 | Julke et al. | 252/519.31 |
| 4,692,735 A | * | 9/1987 | Shoji et al. | 338/21 |
| 4,996,510 A | * | 2/1991 | Becker et al. | 264/617 |
| 5,455,554 A | * | 10/1995 | Sletson et al. | 338/20 |
| 6,232,867 B1 | * | 5/2001 | Yoshida et al. | 29/610.1 |
| 6,342,828 B1 | * | 1/2002 | Hagemeister et al. | 29/610.1 |

FOREIGN PATENT DOCUMENTS

| | | |
|---|---|---|
| DE | 2 365 232 | 7/1974 |
| SE | 466 826 | 4/1992 |

OTHER PUBLICATIONS

Steven Boggs, et al., Increased Energy Absorption in ZnO Arrester Elements Through Control of Electrode Edge Margin, IEEE Transactions on Power Delivery, vol. 15, No. 2, Apr. 2000, pp. 562–568.

* cited by examiner

*Primary Examiner*—Kenneth E. Peterson
*Assistant Examiner*—Isaac Hamilton
(74) *Attorney, Agent, or Firm*—Venable LLP; Eric J. Franklin

(57) ABSTRACT

A method of manufacturing a metal-oxide varistor with improved energy absorption capability. Electrodes are arranged making contact with the end surfaces of the varistor, these end surfaces being coated with metal. The envelope surfaces are supplied with a high-resistance material so as to form a zone with enhanced resistivity close to the envelope surface. According to the invention, a metal-oxide powder is formed into a cylindrical body. The envelope surface of the cylindrical body is coated by spraying, dip-painting, rolling, or some other equivalent method, with a paste or a dispersion of a high-resistance material. After the coating, the coated cylindrical body is sintered at 1100–1300° C. for 2–10 h. During the sintering, the high-resistance material penetrates, by diffusion, into the surface zone of the envelope surface to a depth of 2–6 mm.

5 Claims, No Drawings

METHOD OF MANUFACTURING A METAL-OXIDE VARISTOR WITH IMPROVED ENERGY ABSORPTION CAPABILITY

TECHNICAL FIELD

The invention relates to a method of manufacturing a metal-oxide varistor with electrodes connected at the end surfaces, the energy absorption capability of which has been improved by arranging it such that the current displacement which normally arises, especially in connection with high impulse currents, close to the edges of the electrodes is avoided by increasing the resistivity of the block in the vicinity of the envelope surface. More particularly, the invention relates to a method of achieving a high-resistance zone close to the envelope surface of a metal-oxide varistor, thereby preventing the harmful effects which normally arise in connection with the above-mentioned current displacement.

BACKGROUND ART

Varistors comprising a body of metal-oxide powder, preferably of zinc oxide, with or without stabilizing additives and with electrodes connected at the end surfaces are used because of their nonlinear, voltage-dependent resistivity in current-limiting applications such as, for example, surge arresters. It is known that, at high impulse currents, an increased current density is obtained close to the edges of the electrodes. To avoid this current displacement, which may lead to local overheating of the varistor close to the edge of the electrode and hence to breakdown, it is known to provide the metal-oxide varistor with a high-resistance surface zone which comprises the region close to the edges of the electrodes. In this way, the current displacement is prevented and the current is distributed essentially uniformly over the electrode/varistor contact surface. The ability to be subjected to high impulse currents, without breaking down, for periods of time of the order of magnitude of 1 ms or more is referred to as energy absorption capability.

Usually, see for example German publication DE-OS 2 365 232, the high-resistance surface zone is achieved by applying a paste layer of a suitable material, for example $SiO_2$, $B_2O_3$, $Bi_2O_3$, $Sb_2O_3$, $In_2O_3$, or mixtures thereof, onto a metal-oxide varistor, preferably a zinc-oxide varistor. Thereafter, the varistor with the applied layer is sintered again, thus obtaining a high-resistance layer with a thickness of a few tens of $\mu$m. The high-resistance layer is accomplished partly by diffusion from the applied layer into the metal-oxide varistor, partly by the applied layer sintering to the metal-oxide varistor.

To ensure also a satisfactory high-current capability (impulse currents below 4–20 $\mu$m), while at the same time improving the energy absorption capability, it is required, as described in "Increased Energy Absorption in ZnO Arrester Elements Through Control of Electrode Edge Margin" (IEEE Transactions on Power Delivery, Vol. 15, No. 2, April 2000), that the edges of the electrodes have a certain minimum distance to the envelope surface of the varistor. This distance should be at least 0.3–0.6 mm, which means that the high-resistance layer described above is too thin in order to achieve the desired effect.

To obtain a high energy absorption capability while at the same time ensuring a satisfactory high-current capability, it is desired to achieve a considerably thicker high-resistance zone, 0–6 mm, than what is possible to achieve by applying a paste layer onto a sintered varistor body and diffusion during repeated sintering. According to an alternative method (see Swedish patent publication 466 826), such a thick high-resistance surface zone is obtained by forming a metal-oxide powder into a cylindrical body and heat-treating it at 400–600° C. in order to obtain a porosity of 30–50%, the pores close to the envelope surface being open. The envelope surface is supplied with a metallic salt solution by spraying, dip-painting or some other equivalent method. The metallic salt solution penetrates into the pores to a depth of 2–6 mm, whereupon sintering of the varistor body with the metallic salt supplied thereto is completed at 1100–1300° C. The alternative method thus implies dividing the sintering into two steps, which increases the manufacturing cost.

SUMMARY OF THE INVENTION

According to the invention, a metal-oxide varistor with a high-resistance surface zone of 0–6 mm and hence improved energy absorption capability is manufactured by applying a paste layer of a high-resistance material onto a pressed, but not sintered, cylindrical body of metal-oxide powder, whereupon sintering of the coated body is completed in one step. Thus, the invention eliminates the extra sintering which is required according to the prior art.

A cylindrical metal-oxide varistor is formed by pressing metal-oxide powder. The envelope surface of the cylindrical body pressed by metal-oxide powder, is coated with a paste or a dispersion of a high-resistance material, for example $SiO_2$, $LiO_2$ or $Cr_2O_3$ or salts thereof. The paste or the dispersion may be applied to the envelope surface of the pressed cylindrical body by dip-painting, spraying, rolling or in any other suitable way. After the coating, the coated cylindrical body is sintered at 1100–1300° C. for 2–10 h. During the sintering, the high-resistance material penetrates by diffusion into the surface zone of the envelope surface. The depth of penetration and the amount of absorbed high-resistance material, which controls the resistivity in the surface layer, depend on the composition of the paste, the thickness of the paste, the microstructure of the cylindrical body, the sintering temperature and the sintering time.

EXAMPLES

A metal oxide powder, substantially consisting of zinc oxide (ZnO) with normal additives in the range of 0.1 to 5 mole % of bismuth oxide ($Bi_2O_3$), antimony oxide ($Sb_2O_3$), chromium oxide ($Cr_2O_3$), manganese oxide (MnO), cobalt oxide ($Co_2O_3$) and nickel oxide (NiO), was mixed completely. By spray-drying, all surplus water was removed. The spray-dried powder was formed into cylindrical bodies in a conventional hydraulic press.

Fine-grained silicon dioxide ($SiO_2$) in a dispersion was diluted with water into a suitable consistency. The mixture obtained was applied to the side of the formed body by spray-painting, whereupon the varistor body was completed by sintering at 1150° C. During the sintering, the applied silicon dioxide was diffused to a depth of 5 mm. After the sintering, the two end surfaces were metallized in a known manner and the electrodes were applied.

100 metal oxide varistors with a diameter of 96 mm and a height of 31 mm, and which were manufactured in accordance with the invention, were subjected to repeated energy surges with the duration 4 ms and the energy 13 kJ/kV. All 100 varistors withstood the test. In the same way, 100 metal-oxide varistors with the same diameter and the same height, but to which the invention was not applied, were also tested. Out of these varistors, 10% did not withstand the test.

100 metal-oxide varistors with a diameter of 62 mm and a height of 32 mm, and which were manufactured in accordance with the invention, were subjected to repeated energy surges with the duration 4 ms and the energy 5.6 kJ/kV. All 100 varistors withstood the test. In the same way, 100 metal-oxide varistors with the same diameter and the same height, but to which the invention was not applied, were also tested. Out of these varistors, 8% did not withstand the test.

What is claimed is:

1. A method of manufacturing a cylindrical metal-oxide varistor with improved energy absorption capability, wherein electrodes are arranged making contact with the end surfaces of the metal-oxide varistor, the end surfaces of the varistor are coated with metal, and the envelope surface is supplied with a high-resistance material so as to form a zone with enhanced resistivity close to the envelope surface, the method comprising:

forming a metal-oxide powder into as unsintered cylindrical varistor body;

coating envelope surfaces of the unsintered varistor body with a paste or a dispersion of a high-resistance material comprising $SiO_2$ spraying, dip-painting, rolling, or spraying painting; and sintering the coated varistor body, wherein during sintering the high-resistance material diffuses into the surface of the varistor body to a depth of 2–6 mm.

2. The method according to claim 1, wherein the envelope surface of the formed, non-sintered varistor body is coated with an aqueous dispersion of $SiO_2$.

3. The method according to claim 1, wherein the coated varistor body is sintered at 1100–1300° C. for 2–10 hours.

4. The method according to claim 2, wherein the coated varistor body is sintered at 1100–1300° C. for 2–10 hours.

5. A method of manufacturing a cylindrical metal-oxide varistor with improved energy absorption capability, wherein electrodes are arranged making contact with end surfaces of the metal-oxide varistor, the end surfaces of the varistor are coated with metal, and an envelope surface is supplied with a high-resistance material so as to form a zone with enhanced resistivity close to the envelope surface, the method comprising:

forming a metal-oxide powder into an unsintered cylindrical varistor body;

coating envelope surfaces of the unsintered varistor body with an aqueous dispersion of a high-resistance material comprising $SiO_2$, $LiO_2$ or $Cr_2O_3$ by spraying, dip-painting, rolling, or spray painting; and sintering the coated varistor body at 1100–1300° C. for 2–10 hours, wherein during the sintering the high-resistance material diffuses into the surface zone of the envelope surface of the metal-oxide varistor to a depth of 2–6 mm.

* * * * *